US010407946B2

(12) United States Patent
Capalau et al.

(10) Patent No.: US 10,407,946 B2
(45) Date of Patent: Sep. 10, 2019

(54) VEHICLE DOOR LOCKING SYSTEMS AND CONTROL LOGIC FOR PASSENGER DOOR ASSEMBLIES

(71) Applicant: GM GLOBAL TECHNOLOGY OPERATIONS LLC, Detroit, MI (US)

(72) Inventors: Paul Capalau, Whitby (CA); Michael D. Alarcon, Markham (CA); Jeffrey L. Konchan, Romeo, MI (US); Rondell J. Burge, Ferndale, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 84 days.

(21) Appl. No.: 15/648,947

(22) Filed: Jul. 13, 2017

(65) Prior Publication Data

US 2019/0017299 A1 Jan. 17, 2019

(51) Int. Cl.

| | |
|---|---|
| ***E06B 3/00*** | (2006.01) |
| ***E05B 77/54*** | (2014.01) |
| ***E05B 77/30*** | (2014.01) |
| ***E05B 83/36*** | (2014.01) |
| ***E05B 81/12*** | (2014.01) |
| ***E05B 81/64*** | (2014.01) |
| ***E05B 77/00*** | (2014.01) |
| ***E05B 77/48*** | (2014.01) |

(52) U.S. Cl.

CPC ..... *E05B 77/54* (2013.01); *E05B 77/00* (2013.01); *E05B 77/30* (2013.01); *E05B 77/48* (2013.01); *E05B 81/12* (2013.01); *E05B 81/64* (2013.01); *E05B 83/36* (2013.01); *E05Y 2400/44* (2013.01); *E05Y 2400/45* (2013.01); *E05Y 2400/54* (2013.01); *E05Y 2900/531* (2013.01)

(58) Field of Classification Search

CPC ..... E05B 77/54; E05B 77/48; E05B 77/00; E05B 83/36; B60R 1/06; B05B 81/64; B05B 81/12; E05Y 2900/531; E05Y 2400/54; E05Y 2400/45

USPC ..... 49/25, 506

See application file for complete search history.

(56) References Cited

U.S. PATENT DOCUMENTS

| | | | |
|---|---|---|---|
| 5,263,762 | A | 11/1993 | Long et al. |
| 5,955,854 | A | 9/1999 | Zhang et al. |
| 6,173,233 | B1 | 1/2001 | Janutka et al. |
| 6,615,121 | B2 | 9/2003 | Li |

(Continued)

*Primary Examiner* — Jerry E Redman

(74) *Attorney, Agent, or Firm* — Quinn IP Law

(57) ABSTRACT

Disclosed are foreign object detection systems with control logic for governing use of vehicle door assemblies, and motor vehicles equipped with such FOD systems and logic. Methods are disclosed for regulating operation of a vehicle door locking mechanism. One method includes a vehicle controller determining the operating status of a control protocol that governs use of the locking mechanism. If the operating status is active, the controller receives sensor signals indicative of a location and/or velocity of an object within the sensor's supervision field. If the object is located within a protected door zone and/or the object's velocity is towards the protected zone, the controller determines whether the locking mechanism is locked or unlocked. If the locking mechanism is locked, the controller commands the locking mechanism to maintain the locked state. Conversely, if the locking mechanism is unlocked, the controller commands the locking mechanism to lock and maintain this state.

14 Claims, 2 Drawing Sheets

(56) References Cited

U.S. PATENT DOCUMENTS

| | | | | |
|---|---|---|---|---|
| 7,761,209 | B2 | 7/2010 | Morris et al. | |
| 8,280,593 | B2 | 10/2012 | Nakakura et al. | |
| 8,938,337 | B2 | 1/2015 | Nakakura et al. | |
| 9,174,517 | B2 | 11/2015 | Scheuring et al. | |
| 9,447,612 | B2 | 9/2016 | Oakley et al. | |
| 9,573,446 | B2 | 2/2017 | Scheuring et al. | |
| 9,751,462 | B2 * | 9/2017 | Compton | B60Q 9/00 |
| 2003/0222758 | A1 | 12/2003 | Willats et al. | |
| 2009/0033477 | A1 | 2/2009 | Illium et al. | |
| 2009/0260289 | A1 | 10/2009 | Carpenter et al. | |
| 2010/0076651 | A1 | 3/2010 | Nakakura et al. | |
| 2010/0145617 | A1 | 6/2010 | Okada et al. | |
| 2010/0228448 | A1 | 9/2010 | Nakakura et al. | |
| 2012/0221236 | A1 | 8/2012 | Zeller et al. | |
| 2012/0324791 | A1 | 12/2012 | Parsadayan et al. | |
| 2013/0085975 | A1 | 4/2013 | Wellhoefer et al. | |
| 2013/0104459 | A1 | 5/2013 | Patel et al. | |
| 2013/0113614 | A1 | 5/2013 | Yopp | |
| 2013/0234844 | A1 | 9/2013 | Yopp | |
| 2014/0150581 | A1 | 6/2014 | Scheuring et al. | |
| 2014/0195109 | A1 * | 7/2014 | Lange | E05B 77/54 701/36 |
| 2015/0330112 | A1 * | 11/2015 | Van Wiemeersch | E05B 81/76 292/201 |
| 2016/0002959 | A1 * | 1/2016 | Javadzadeh | E05B 77/12 701/46 |
| 2019/0017299 | A1 * | 1/2019 | Capalau | E05B 77/54 |
| 2019/0055770 | A1 * | 2/2019 | Bars | E05F 15/616 |

* cited by examiner

VEHICLE DOOR LOCKING SYSTEMS AND CONTROL LOGIC FOR PASSENGER DOOR ASSEMBLIES

INTRODUCTION

The present disclosure relates generally to compartment closure assemblies for motor vehicles, such as side doors, liftgates, tailgates, trunk lids, engine hoods, and the like. More specifically, aspects of this disclosure relate to vehicle door locking systems and control algorithms for governing use of passenger door assemblies.

Many current production motor vehicles, such as the modern-day automobile, are originally equipped with various compartment closure assemblies that are movably mounted to the vehicle body to provide access to the vehicle's assorted compartments. Driver-side and passenger-side vehicle doors, for example, can be opened and closed to allow user access for entering and exiting the passenger compartment. In contrast, the engine hood (or "bonnet" in some countries) extends over and covers the vehicle's engine compartment to prevent theft or damage of engine and/or motor components, depending on powertrain type. A traditional trunk compartment, on the other hand, is a large storage bin located at the rear of the vehicle and covered by a trunk lid that is hinged underneath the passenger compartment's rear deck. By comparison, pickup trucks and other cargo transport vehicles (e.g., sport utility vehicles (SUV), cargo vans, box trucks, etc.) may be typified by a rear cargo compartment that is closed off at the tail end by a hinged liftgate, tailgate, or door assembly.

Vehicle door assemblies are oftentimes equipped with a locking mechanism that is designed, for example, to prevent the door from inadvertently opening during operation of the vehicle and to inhibit unauthorized access when the vehicle is unattended. Many of these locking mechanisms may be operated from the inside of the vehicle by manipulating a lock knob or button located next to the window frame, packaged along an upper portion of an interior door trim panel. There are a variety of additional ways to lock and unlock a vehicle door, including using a key, a power lock switch, an electronic human machine interface (HMI) on the outside of the door, or by using a remote keyless system, such as an electronic key fob. When unlocked, either manually or through an electronic interface, the door assembly may be opened for entry and egress through operation of a door handle or activation of an automated door system (e.g., a pneumatic, hydraulic, or motor-driven device for automatically opening and closing power liftgates, power side doors, etc.).

During operation of a vehicle door assembly, a foreign object may unexpectedly enter and obstruct the opening or closing path of the door. To obviate the likelihood of damage to the vehicle and object, most power-actuated vehicle door assemblies include protectionary mechanisms, oftentimes in the form of an "anti-pinch" switch, that operate to reverse or stop the motion of the door assembly upon contact with the foreign object. While these features serve to minimize damage to the vehicle and object, they require that the door assembly be moving and physically contact the object before activating. As a preventative security measure, some vehicles employ a proximity sensor to detect the presence of objects obstructing the path of the vehicle door assembly, and responsively disable the door assembly's automated driving system. These proximity sensor systems, however, are typically limited to detecting objects within the path of the door assembly. In addition, both of the foregoing systems operate by regulating the automated door's driving mechanism and, thus, would not function with passenger door assemblies that are not equipped with the requisite automation hardware and software.

SUMMARY

Disclosed herein are foreign object detection systems and control logic for governing use of vehicle door assemblies, methods for making and methods for using such systems, and motor vehicles equipped with a vehicle door assembly and foreign object detection (FOD) capabilities to regulate operation of the door assembly. By way of example, and not limitation, there is presented a novel vehicle door lock control algorithm designed to prevent impact between an opening side door of a stopped or slowed vehicle and an object traversing alongside the vehicle and bound to intersect the door's swing radius. Upon sensing a vulnerable object approaching the vehicle, or sensing the vulnerable object's presence within the door's swing radius for a calibrated window of time (e.g., approximately 10 seconds), the control algorithm will automatically lock or retain locked the vehicle door's locking mechanism. For instance, the vehicle door lock control algorithm overrides an automatic door unlock feature that normally unlocks the vehicle side doors when the vehicle is shifted into park position. To open one of the side doors, a user may then be required and, optionally, prompted to deactivate the vehicle door lock control algorithm, e.g., with a double pull of the inside door handle. An audible and/or visual warning may be generated to warn the user of an impending impact between the vehicle door and the object.

Attendant benefits for at least some of the disclosed concepts include improved FOD capabilities that enable rapid warning of the vehicle's occupant(s) if they attempt to open a vehicle door when there is an oncoming object. Disclosed vehicle door lock control algorithms also help to delay the vehicle door from being opened when an oncoming object is detected to thereby preclude a potential impact condition. On the other hand, disclosed control logic protects occupant egress from the vehicle in the event of electrical power loss or electrical component failure, as it does not block manual override and mechanical unlocking/unlatching via inside handle actuation. These features, in turn, help to improve customer confidence levels towards vehicle foreign object detection and impact prevention systems.

Aspects of the present disclosure are directed to control algorithms for detecting foreign objects proximate a vehicle closure assembly, and attendant logic for regulating operation of the closure assembly to avoid inadvertent contact with a detected object. Disclosed, for example, is a method for regulating operation of a locking mechanism of a motor vehicle's door assembly. The vehicle door assembly is movably mounted to the vehicle body to transition between closed and open positions to respectively cover and uncover an opening to a vehicle compartment. The method includes, in any order and in any combination with any of the disclosed features: determining, via a vehicle controller, an operating status of a vehicle door lock control protocol that governs use of the locking mechanism (e.g., controller receives activation/deactivation input through an electronic driver information center (DIC)); responsive to the operating status being active, the vehicle controller receives, from one or more sensing devices, one or more sensor signals indicative of a location and/or velocity of an object within the sensor's supervision field, which includes a protected door zone for the door assembly; if the object is located inside the protected zone or the object's velocity is aimed towards the protected zone, the vehicle controller responsively determines whether the door locking mechanism is locked or unlocked; if the locking mechanism is in a locked state, the controller responsively outputs a command signal to the locking mechanism to maintain the locked state, e.g., until the object passes or exits the protected door zone; if, however, the locking mechanism is in an unlocked state, the controller responsively outputs a command signal to the locking mechanism to transition to the locked state and to maintain the locked state. The method may further include the vehicle controller receiving a user override request to override the door lock control protocol, and responsively commanding the locking mechanism to transition from the locked state to the unlocked state. If the motor vehicle includes an automatic door unlock feature that automatically unlocks the locking mechanism when the vehicle powertrain is shifted into park mode, the command signal to maintain the locked state may include an override command that disables the automatic door unlock feature.

Other aspects of the present disclosure are directed to motor vehicles with a vehicle closure assembly and foreign object detection capabilities to regulate operation of the closure assembly to preclude a potential impact condition. A "motor vehicle," as used herein, may include any relevant vehicle platform, such as passenger vehicles (internal combustion engine (ICE), hybrid, full electric, fuel cell, fully or partially autonomous, etc.), commercial vehicles, industrial vehicles, tracked vehicles, off-road and all-terrain vehicles (ATV), farm equipment, boats, airplanes, etc. In the same vein, a "closure assembly," as used herein, may include any relevant vehicle component, such as an occupant side door (sliding or hinged), a liftgate, a tailgate, a cargo compartment door, etc. A motor vehicle is disclosed that includes a vehicle body with a passenger compartment, and a vehicle door assembly movably mounted to the vehicle body to selectively transition between closed and open positions to respectively cover and uncover an access opening to the passenger compartment. The vehicle door assembly includes a locking mechanism for selectively locking the door assembly in the closed position. A proximity sensor mounted to the vehicle body is operable to detect objects within the sensor's supervision field. The supervision field includes a protected door zone that envelopes the swing radius of the vehicle door assembly. The supervision field may also include a rear projected area adjacent a rear quarter panel of the vehicle, and/or a forward projected area adjacent a front fender panel of the vehicle.

The motor vehicle also includes a vehicle controller, such as a programmable electronic control unit (ECU), that communicates with the door locking mechanism and the proximity sensor. The vehicle controller is programmed to: receive a sensor signal from the proximity sensor indicative of a location and/or velocity of an object within the sensor's supervision field; if the object's location is inside the protected door zone or the object's velocity is directed towards the protected door zone, determine whether the locking mechanism is locked or unlocked; if it is determined that the locking mechanism is in a locked state, output a command signal to the locking mechanism to maintain the locked state; and, if it is determined that the locking mechanism is in an unlocked state, output a command signal to the locking mechanism to transition to the locked state and to maintain the locked state.

Additional aspects of the present disclosure are directed to non-transitory, computer readable media storing instructions executable by at least one of one or more processors of one or more in-vehicle electronic control units. These instructions, when executed, cause the ECU(s) to perform various operations, which may include, in any order and in any combination with any features presented in this disclosure: determining an operating status of a vehicle door lock control protocol operable to govern use of the locking mechanism; responsive to the operating status of the vehicle door lock control protocol being active, receiving a sensor signal from a sensing device indicative of a location and/or a velocity of an object within a sensor supervision field, which includes a protected zone of the vehicle door assembly; responsive to a determination that the object location is inside the protected zone or the object velocity is directed towards the protected zone, determining whether the locking mechanism is in a locked state or an unlocked state; responsive to a determination that the locking mechanism is in the locked state, outputting a command signal to the locking mechanism to maintain this locked state; and, responsive to a determination that the locking mechanism is in the unlocked state, outputting a command signal to the locking mechanism to transition to the locked state and to maintain the locked state.

The above summary is not intended to represent every embodiment or every aspect of the present disclosure. Rather, the foregoing summary merely provides an exemplification of some of the novel aspects and features set forth herein. The above features and advantages, and other features and advantages of the present disclosure, will be readily apparent from the following detailed description of representative embodiments and representative modes for carrying out the present disclosure when taken in connection with the accompanying drawings and the appended claims. Moreover, this disclosure expressly includes any and all combinations and subcombinations of the elements and features presented above and below.

Figure 1:
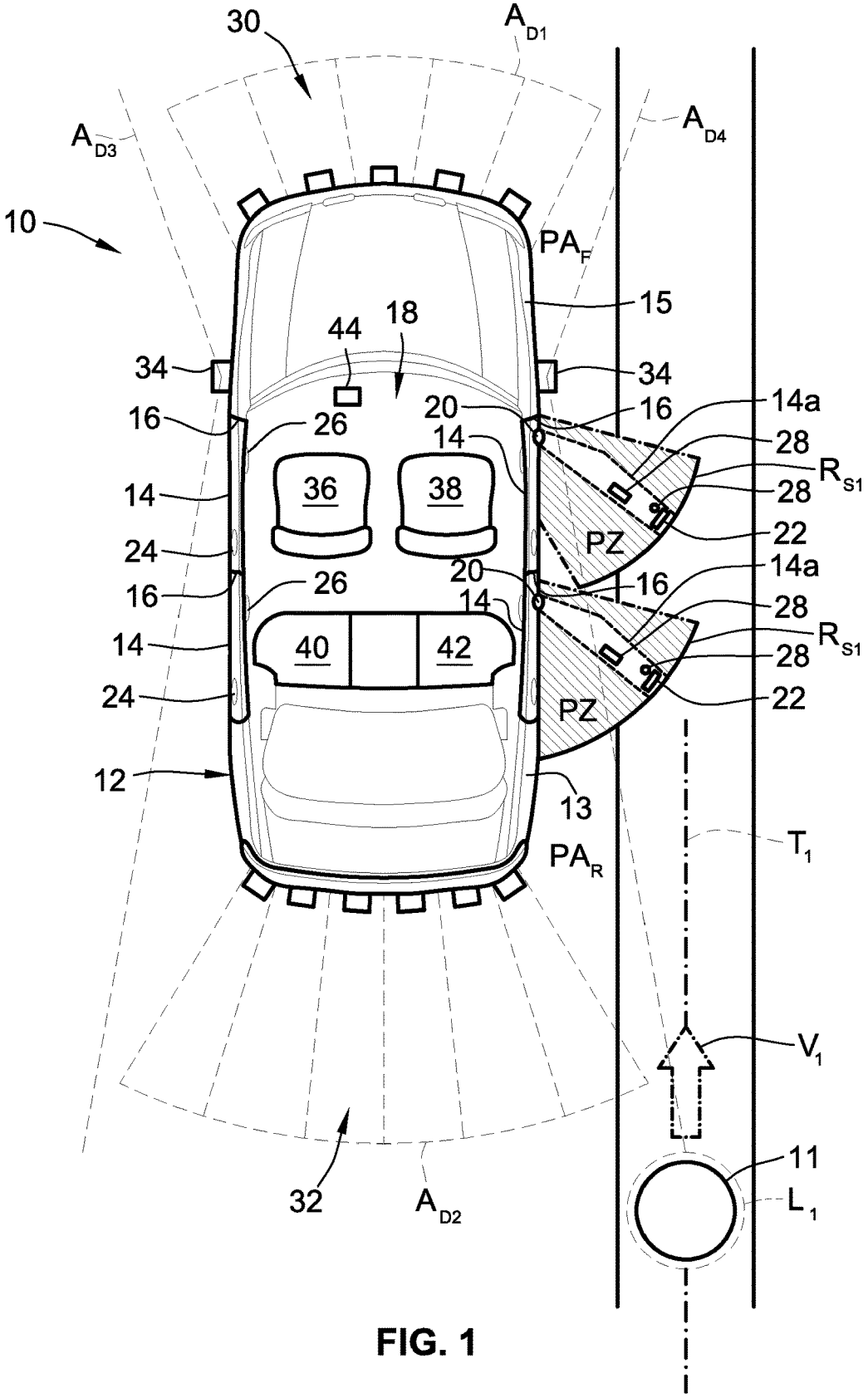
FIG. 1 is a schematic plan-view illustration of a representative motor vehicle with driver-side and passenger-side door assemblies and a foreign object detection (FOD) system with vehicle door lock control capabilities in accordance with aspects of the present disclosure.

The present disclosure is amenable to various modifications and alternative forms, and some representative embodiments have been shown by way of example in the drawings and will be described in detail herein. It should be understood, however, that the novel aspects of this disclosure are not limited to the particular forms illustrated in the appended drawings. Rather, the disclosure is to cover all modifications, equivalents, combinations, subcombinations, permutations, groupings, and alternatives falling within the scope and spirit of the disclosure as defined by the appended claims.

DETAILED DESCRIPTION

This disclosure is susceptible of embodiment in many different forms. There are shown in the drawings and will herein be described in detail representative embodiments of the disclosure with the understanding that these illustrated examples are to be considered an exemplification of the disclosed principles and do not limit the broad aspects of the disclosure to the representative embodiments. To that extent, elements and limitations that are disclosed, for example, in the Abstract, Summary, and Detailed Description sections, but not explicitly set forth in the claims, should not be incorporated into the claims, singly or collectively, by implication, inference or otherwise. For purposes of the present detailed description, unless specifically disclaimed: the singular includes the plural and vice versa; the words "and" and "or" shall be both conjunctive and disjunctive; the word "all" means "any and all"; the word "any" means "any and all"; and the words "including" and "comprising" and "having" and synonyms thereof mean "including without limitation." Moreover, words of approximation, such as "about," "almost," "substantially," "approximately," and the like, may be used herein in the sense of "at, near, or nearly at," or "within 3-5% of," or "within acceptable manufacturing tolerances," or any logical combination thereof, for example.

Referring now to the drawings, wherein like reference numbers refer to like features throughout the several views, there is shown in FIG. 1 an illustration of a representative automobile, which is designated generally at 10 and portrayed herein for purposes of discussion as a four-door, sedan-type passenger vehicle. Mounted at port and starboard flanks of the vehicle's body 12 (e.g., along left-hand and right-hand sides in FIG. 1) are various compartment closure assemblies, including driver-side and passenger-side vehicle door assemblies 14 movably coupled to individual door frames 16 around the vehicle's passenger compartment 18. The illustrated automobile 10—also referred to herein as "motor vehicle" or "vehicle" for short—is merely an exemplary application with which aspects and features of this disclosure may be practiced. In the same vein, implementation of the present concepts for an occupant door assembly 14 should be appreciated as a representative application of the novel aspects and features disclosed herein. As such, it will be understood that aspects and features of this disclosure may be applied to other compartment closure assemblies, and implemented for any logically relevant type of motor vehicle. Lastly, the drawings presented herein are not necessarily to scale and are provided purely for instructional purposes. Thus, the specific and relative dimensions shown in the drawings are not to be construed as limiting.

The driver-side and passenger-side door assemblies 14 of FIG. 1 are shown pivotally mounted to the vehicle body 12, e.g., via multi-stage, check-spring door hinges 20. These hinges 20 allow each door assembly 14 to revolve about a discrete pivot axis that extends generally vertically along a forward edge of its door frame 16 to provide or prevent access to the interior passenger compartment 18. With this configuration, an individual door assembly 14 can be manually and/or automatically swung about its hinge axis back-and-forth between closed and open positions. When in a closed position, the door assembly 14 generally extends across and obstructs a corresponding access opening to the passenger compartment 18 (e.g., both port-side vehicle door assemblies 14 of FIG. 1 are shown closed). Conversely, when in an open position, the door assembly 14 is displaced along a swing radius RS1 from and, thus, uncovers the access opening (e.g., both starboard-side passenger doors are shown hidden at 14*a* in FIG. 1 in open positions). While shown using a standard door mounting configuration, other door mounting configurations, including gull-wing, suicide, butterfly, canopy, sliding, etc., are also deemed to be within the scope of this disclosure.

With continuing reference to FIG. 1, each vehicle door assembly 14 is equipped with a door latch system (represented in the drawings by rotating claw latch 22) for securing the door assembly 14 to the door frame 16 in the closed position. By way of example, and not limitation, a manually operated exterior or interior door handle 24 and 26, respectively, is pulled, pivoted or activated by a user to apply a tensile force to an internal cable of the door latch system and thereby activate a spring-biased claw. This disengages the door latch, which allows the door assembly 14 to be moved to an open position. Upon release of both door handles 24, 26, the internal cable, which may be of the "Bowden Cable" type, will be biased back to its original position by the spring-biased latch. This allows the latch mechanism to reengage a complementary latch plate on the door frame's aft pillar when the door 14 is moved back to the closed position. An optional door locking mechanism—represented herein by lock knob 28—is provided to prevent unwanted activation of the door latch system. It is envisioned that other known and hereafter developed mechanical, electro-mechanical, electronic, and fully automated systems be employed for securing closed and locking the vehicle door assemblies.

To help prevent unwanted or otherwise inadvertent contact between an opening door assembly 14 and an oncoming object (e.g., shown schematically at 11 in FIG. 1 with a rectilinear trajectory T1 traversing the vehicle's starboard side), the vehicle 10 is equipped with a foreign object detection (FOD) system and complementary control logic for regulating movement of one or more or all of the door assemblies 14. According to the illustrated example, FOD system employs assorted sensing devices to monitor select regions within the vehicle's surrounding vicinity. By way of non-limiting example, a first array of ultrasonic sensors 30 cooperatively generate a first forward-projecting detection area $A_{D1}$, a second array of ultrasonic sensors 32 cooperatively generate a second rearward-projecting detection area $A_{D2}$, and two side cameras 34 respectively generate third and fourth laterally-projecting detection areas $A_{D3}$ and $A_{D4}$ on port and starboard sides of the vehicle 10. Individually, cooperatively, or in select combinations, these detection areas $A_{D1\text{-}4}$ define a supervision field within which can be detected moving and stationary foreign objects. These sensors 30, 32, 34 are operable, for example, through collaborative operation with an in-vehicle electronic control unit (ECU) 44, to detect locations, measure distances, calculate trajectories, and/or sense positional changes and velocities of objects within their respective detection areas. This data can be registered, recorded, transmitted and electronically analyzed, for example, to enable automated preventative measures by the automobile's in-vehicle software platform. While described herein as active pixel sensor (APS) and ultrasonic-enabled sensing devices, each sensor 30, 32, 34 may be any appropriate sensing device, such as infrared, radar, laser, capacitive, magnetic, etc. Moreover, the sensor(s) 30, 32, 34 may be packaged at alternative locations throughout the vehicle 10.

By monitoring regions fore and aft of the vehicle body 12, as well as those regions immediately adjacent the vehicle's front fender panels, rear quarter panels, and side doors, the FOD system can generate system alerts for objects within a protected zone PZ (shown with cross-hatching in FIG. 1) of each vehicle door assembly 14 as well as objects expected to navigate through a protected zone PZ. For instance, a predetermined swing radius $R_{S1}$ of each vehicle door assembly 14, which is generally established during vehicle design and calibration, may be compared with a detected location $L_1$, sensed velocity $V_1$, and/or calculated trajectory $T_1$ of the obstacle 11 in order to determine if an impact condition is probable or imminent. In order to minimize false-positive alarms and, if possible, to only monitor vehicle doors 14 at risk of impact, occupied or unoccupied statuses of the front-driver, front-passenger, rear-left and rear-right occupant seats 36, 38, 40 and 42, respectively, may also be monitored. For example, if only the front-driver and rear-left occupant seats 36, 40 are occupied, a bicyclist on the starboard side of the vehicle 10 does not represent an impact risk because it is highly improbable that the bicyclist's trajectory will intersect the swing radius of the corresponding port-side vehicle door assemblies 14.

Figure 2:
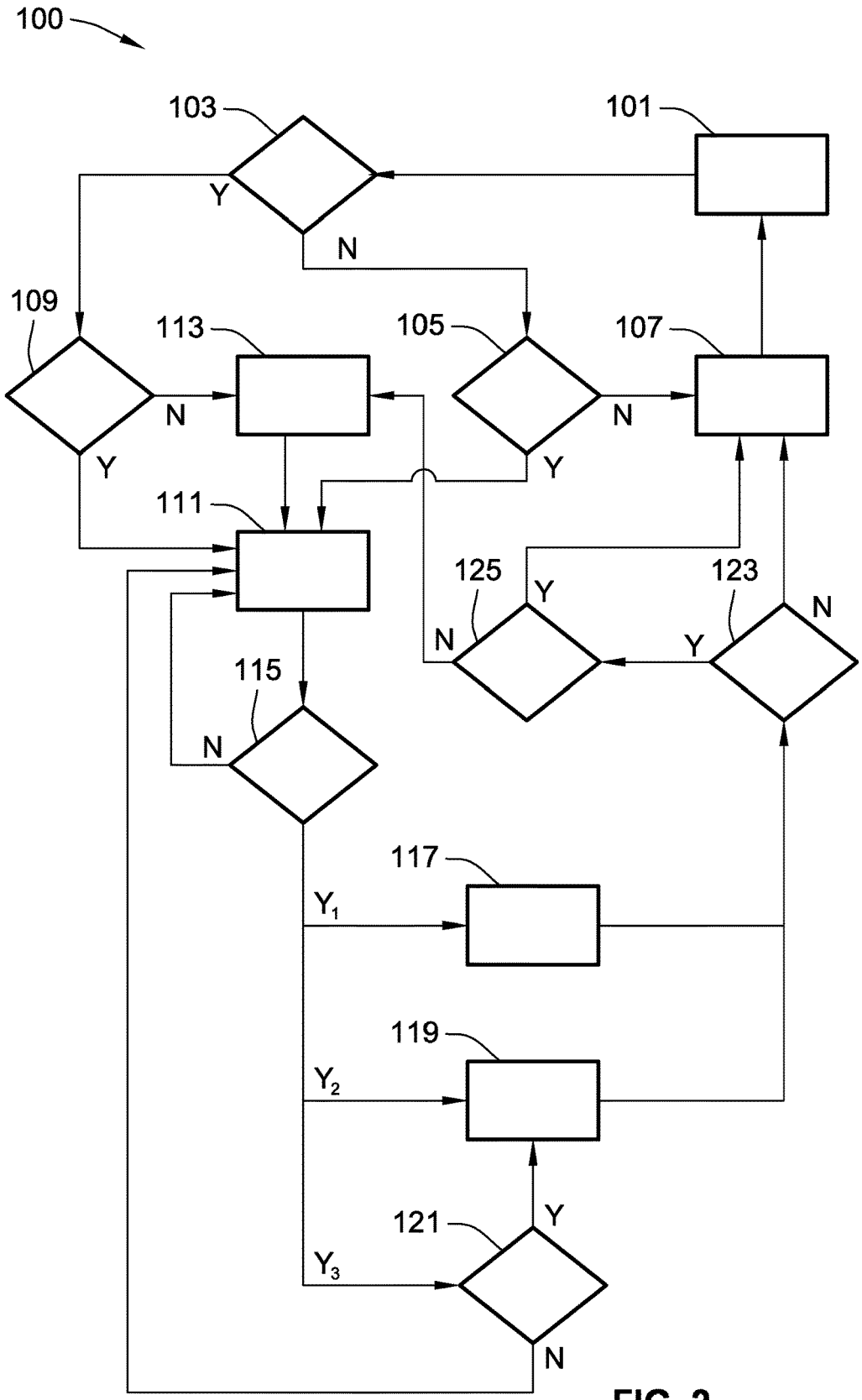
FIG. 2 is a flowchart for a representative vehicle door lock control protocol that may correspond to memory-stored instructions executed by onboard control-logic circuitry, programmable electronic control unit, or other computer-based device of a motor vehicle in accord with aspects of the disclosed concepts.

With reference now to the flow chart of FIG. 2, an improved method or control strategy for operating a foreign object detection system, such as FOD system 30, 32, 34 of FIG. 1, to govern use of a door locking mechanism, such as vehicle door lock 28, to thereby regulate use of a compartment closure assembly, such as vehicle side door 14, for example, is generally described at 100 in accordance with aspects of the present disclosure. Some or all of the operations illustrated in FIG. 2 and described in further detail below can be representative of an algorithm that corresponds to processor-executable instructions that can be stored, for example, in main or auxiliary or remote memory, and executed, for example, by an ECU, a central processing unit (CPU), an on-board or remote control logic circuit, or other module or device, to perform any or all of the above and/or below described functions associated with the disclosed concepts.

Method 100 of FIG. 2 starts at terminal block 101 with identifying the operating status of a vehicle door lock control protocol that is operable to govern use of a vehicle door locking mechanism based, e.g., on data feedback from an onboard FOD system. By way of non-limiting example, a vehicle controller, such as ECU 44 of FIG. 1, receives an activation or a deactivation input from the vehicle driver or other occupant through an electronic driver information center (DIC), which may be implemented through a touch-screen video display panel that is positioned in a center stack of the passenger compartment. In this instance, the operating status of the door lock control protocol is deemed active at block 101 if the received input indicates an activation (ON) selection. For at least some applications, protocol initiation may be automated and, thus, independent of user input. For instance, the operating status of the vehicle door lock control protocol is deemed active whenever the speed of the motor vehicle 10 is below a calibrated maximum vehicle speed (e.g., an engine torque signal or a power transmission gear state indicates the vehicle is moving at or below a calibrated idle speed). Conversely, the control protocol may be deemed inactive and, thus, the method 100 temporarily disabled when the vehicle speed exceeds idle or other calibrated threshold speed. As yet another option, door lock control protocol operating status is automatically activated whenever the vehicle 10 is in park (e.g., the vehicle powertrain is shifted into a park mode). For at least some applications, terminal block 101 is merely an initialization operation (START) that does not require actively determining the operating status of the control protocol. That is, the method 100 may be automatically executed in a continuous or intermittent loop whenever the motor vehicle 10 is stopped or expected to stop.

During active operation of the vehicle door lock control protocol, an onboard vehicle controller will receive sensor signals from one or more sensing devices operatively arranged to detect foreign objects that are about to enter, that are entering, or that have already entered the sensor's/s' supervision field. ECU 44 of FIG. 1, for example, may be programmed to complete processor-executable instructions to poll or prompt select sensors 30, 32, 34 to begin monitoring one or more or all of the detection areas $A_{D1\text{-}4}$ to establish whether or not a foreign object 11 has entered one of the detection areas $A_{D1\text{-}4}$. As indicated above, a supervision field for a given door assembly 14 may include: the protected zone PZ enveloping the door's swing radius $R_{S1}$, a rear projected area $PA_R$ adjacent a rear quarter panel 13 of the motor vehicle 10, a forward projected area $PA_F$ adjacent a front fender panel 15 of the motor vehicle 10, and/or any of the other detection areas illustrated in FIG. 1. When a foreign object 11 is detected at decision block 103, sensor-generated signals may be analyzed, e.g., via ECU 44, to determine the object's location $L_1$, proximity $P_1$, and/or trajectory $T_1$ in order to calculate whether or not that object 11 is likely to intersect a swing radius $R_{S1}$ of an opening door assembly 14. If, however, a foreign object is not detected (Block 103=NO), method 100 may responsively terminate the vehicle door lock control protocol. In the same vein, if a foreign object has been detected but the detected object's location is not inside the protected zone PZ and that object's velocity is not pointing towards the protected zone PZ (Block 103=NO), method 100 may responsively terminate the control protocol. Before terminating, the method 100 may optionally determine at decision block 105 if a desired vehicle door assembly or all the vehicle door assemblies is/are locked; if not (Block 105=NO), the method 100 proceeds to process block 107, passively or actively maintains the doors in an unlocked state, and returns to block 101. If one or more of the door assemblies are locked (Block 105=YES), the method 100 may proceed to decision block 111, which will be explained in additional detail below.

Contemporaneous with or immediately after detecting a foreign object and establishing that this object is likely to collide with an opening vehicle door 14—the detected object is located inside a door assembly's protected zone PZ or the detected object's velocity is directed at a protected zone PZ (Block 103=YES)—the method 100 responsively implements decision block 109 to determine whether the locking mechanism of the likely impacted door or doors is/are in a locked state. If all relevant locking mechanisms are in the locked state (Block 109=YES), the method 100 proceeds to process block 111 with processor-executable instructions that cause a vehicle controller to transmit a command signal to the locking mechanism(s) to maintain the locked state, e.g., for a calibrated minimum period of time and/or until the object passes or exits the protected door zone. On the other hand, if the locking mechanism is in an unlocked state (Block 109=NO), the method 100 proceeds to process block 113, with instructions that cause a vehicle controller to transmit a command signal to the locking mechanism(s) to transition to the locked state, and then to process block 111, with instructions to maintain the locked state. In so doing, the control protocol helps to delay the vehicle door(s) from being opened when a vulnerable object is detected and, thus, helps to preclude a potential impact condition. Optional embodiments may further require, responsive to a positive determination at block 103, e.g., as part of blocks 109, 111, or 113, instructions for a vehicle controller to generate and transmit one or more command signals to a sound generating device (e.g., a vehicle horn or audio speaker) and/or a display device (e.g., a vehicle instrument cluster or center stack display) to generate an audible or visual warning that a vulnerable object is approaching the vehicle or is already obstructing the opening path of one or more vehicle door assemblies.

Some automobile platforms employ a door control module programmed with an automatic door unlock feature that is designed to automatically unlock the driver door or, in some system architectures, all occupant doors when the vehicle's PRNDL shift knob is moved to park, i.e., such that the vehicle powertrain shifts into park mode. In such instances, process block 113 or 115 may optionally require processor-executable instructions that override or otherwise disable the automatic door unlock feature such that the locking mechanism(s) can be shifted into and maintained in the locked state. Likewise, most modern-day vehicle door assemblies are equipped with a manually activated, internally mounted power door lock switch 46 of FIG. 1 that is selectively operable to unlock one or more or all door locking mechanisms. In this case, process block 113 or 115 may optionally require processor-executable instructions that override or otherwise disable the power door lock switches such that the locking mechanism(s) can be shifted into and maintained in the locked state.

After the vehicle door or doors have been automatically locked and retained locked to obviate the likelihood of a door impact condition, an occupant may wish to alight from the vehicle on their own volition. According to the representative control logic set forth in FIG. 2, the method 100 proceeds to decision block 115 to determine if a manual or audible user override request has been received to override the vehicle door lock control protocol. For at least some preferred system configurations, a manual user override request may come in the form of multiple sequential actuations (e.g., two consecutive pulls) of an inside door handle, such as interior door handle 26 of FIG. 1. If a manual user override request of this form is received (Block 115=Y1), the method 100 proceeds to process block 117 to output a command signal for unlocking the individual door assembly associated with the pulled handle. Optionally or alternatively, a manual user override request may come in the form of multiple sequential activations (e.g., three consecutive depressions) of an electronic unlocking trigger, such as power door lock switch 46. If a manual user override request of this form is received (Block 115=Y2), method 100 of FIG. 2 proceeds to process block 119 to output a command signal for unlocking all of the vehicle door assemblies. It should be appreciated that the above examples are merely representative and other types of user override requests may be employed via the control logic of FIG. 2. In some instances, an override request may be received via a data communication module (DCM), e.g., when the vehicle is in park; when received (Block 115=Y3), the method 100 proceeds to decision block 121 and determines whether or not the automatic door unlock feature has been activated (e.g., via driver input at DIC). If not (Block 121=NO), the method 100 returns to block 111 and the vehicle doors remain locked; if so (Block 121=YES), the method 100 proceeds to block 119 to unlock all of the vehicle door assemblies.

After issuing the command signals to lock/maintain locked the vehicle door assemblies, the method 100 of FIG. 2 proceeds from blocks 117 and 119 to decision block 123, which includes processor-executable instructions for a vehicle controller, such as ECU 44, to determine if a detected object is still located inside the protected zone or a detected object velocity/trajectory intersects the protected zone after a calibrated period of time (e.g., 10 seconds). If a negative determination is returned (Block 123=NO), the method 100 proceeds to block 107 and includes control logic to responsively output a command signal to one or more or all of the locking mechanisms to transition to the unlocked state. On the contrary, in response to a determination that a detected object is still located inside the protected door zone or the object's velocity/trajectory still intersects with the protected door zone after the calibrated period of time, method 100 proceeds to decision block 125 to determine if another ($3^{rd}$) attempt has been made to relock the vehicle doors. If not (block 125=NO), the method proceeds to block 113 and transmits a command signal to lock the vehicle doors; if so (block 125=YES), the method proceeds to block 107 and commands the locking mechanism to unlock/maintain the unlocked state for a calibrated extended timeframe.

Aspects of this disclosure may be implemented, in some embodiments, through a computer-executable program of instructions, such as program modules, generally referred to as software applications or application programs executed by an on-board vehicle computer. The software may include, in non-limiting examples, routines, programs, objects, components, and data structures that perform particular tasks or implement particular abstract data types. The software may form an interface to allow a computer to react according to a source of input. The software may also cooperate with other code segments to initiate a variety of tasks in response to data received in conjunction with the source of the received data. The software may be stored on any of a variety of memory media, such as CD-ROM, magnetic disk, bubble memory, and semiconductor memory (e.g., various types of RAM or ROM).

Moreover, aspects of the present disclosure may be practiced with a variety of computer-system and computer-network configurations, including multiprocessor systems, microprocessor-based or programmable-consumer electronics, minicomputers, mainframe computers, and the like. In addition, aspects of the present disclosure may be practiced in distributed-computing environments where tasks are performed by remote-processing devices that are linked through a communications network. In a distributed-computing environment, program modules may be located in both local and remote computer-storage media including memory storage devices. Aspects of the present disclosure may therefore, be implemented in connection with various hardware, software or a combination thereof, in a computer system or other processing system.

Any of the methods described herein may include machine readable instructions for execution by: (a) a processor, (b) a controller, and/or (c) any other suitable processing device. Any algorithm, software, or method disclosed herein may be embodied in software stored on a tangible medium such as, for example, a flash memory, a CD-ROM, a floppy disk, a hard drive, a digital versatile disk (DVD), or other memory devices, but persons of ordinary skill in the art will readily appreciate that the entire algorithm and/or parts thereof could alternatively be executed by a device other than a controller and/or embodied in firmware or dedicated hardware in other manners (e.g., it may be implemented by an application specific integrated circuit (ASIC), a programmable logic device (PLD), a field programmable logic device (FPLD), discrete logic, etc.). Further, although specific algorithms are described with reference to flowcharts depicted herein, persons of ordinary skill in the art will readily appreciate that many other methods of implementing the example machine readable instructions may alternatively be used. For example, the order of execution of the blocks may be changed, additional blocks may be added, and/or some of the blocks described may be modified, eliminated, or combined.

While aspects of the present disclosure have been described in detail with reference to the illustrated embodiments, those skilled in the art will recognize that many modifications may be made thereto without departing from the scope of the present disclosure. The present disclosure is not limited to the precise construction and compositions disclosed herein; any and all modifications, changes, and variations apparent from the foregoing descriptions are within the scope of the disclosure as defined in the appended claims. Moreover, the present concepts expressly include any and all combinations and subcombinations of the preceding elements and features.

What is claimed:

1. A method for regulating operation of a locking mechanism of a vehicle door assembly for a motor vehicle, the method comprising:

determining, via a vehicle controller, an operating status of a vehicle door lock control protocol operable to govern use of the locking mechanism;

responsive to the operating status of the vehicle door lock control protocol being active, receiving, via the vehicle controller from a sensing device, a sensor signal indicative of a location or a velocity, or both, of an object within a supervision field with a protected zone;

responsive to a determination that the object location is in the protected zone of the vehicle door assembly or the object velocity is towards the protected zone, determining, via the vehicle controller, whether the locking mechanism is in a locked state or an unlocked state;

responsive to a determination that the locking mechanism is in the locked state, outputting a command signal to the locking mechanism to maintain the locked state; and responsive to a determination that the locking mechanism is in the unlocked state, outputting a command signal to the locking mechanism to transition to the locked state and to maintain the locked state.

2. The method of claim 1, further comprising, responsive to receiving a user override request to override the vehicle door lock control protocol, outputting a command signal to the locking mechanism to transition from the locked state to the unlocked state.

3. The method of claim 2, wherein the vehicle door assembly includes a latching mechanism and an inside door handle configured to unlatch the latching mechanism, and wherein the user override request includes multiple sequential pulls of the inside door handle.

4. The method of claim 2, wherein the vehicle door assembly includes a manually activated power lock switch selectively operable to unlock the locking mechanism, and wherein the user override request includes multiple sequential activations of the power lock switch.

5. The method of claim 1, wherein the motor vehicle includes an automatic door unlock feature operable to automatically unlock the locking mechanism when a powertrain of the motor vehicle is shifted into a park mode, and wherein the command signal to maintain the locked state includes an override command disabling the automatic door unlock feature.

6. The method of claim 1, wherein the vehicle door assembly includes a manually activated power lock switch selectively operable to unlock the locking mechanism, and wherein the command signal to maintain the locked state includes an override command disabling the power lock switch.

7. The method of claim 1, further comprising, responsive to a determination that the object location is not inside the protected zone and the object velocity is not towards the protected zone, deactivating the vehicle door lock control protocol.

8. The method of claim 1, further comprising:

determining, after issuing the command signal to maintain the locked state, if the object location is inside the protected zone or the object velocity is towards the protected zone after a calibrated period of time; and responsive to a determination that the object location is not inside the protected zone and the object velocity is not towards the protected zone after the calibrated period of time, outputting a command signal to the locking mechanism to transition to the unlocked state.

9. The method of claim 8, further comprising, responsive to a determination that the object location is inside the protected zone or the object velocity is towards the protected zone after the calibrated period of time, outputting a command signal to the locking mechanism to maintain the locked state for a calibrated extended timeframe.

10. The method of claim 1, wherein the motor vehicle includes a sound generating device, the method further comprising, responsive to a determination that the object location is inside the protected zone or the object velocity is towards the protected zone, outputting a command signal to the sound generating device to generate an audible warning.

11. The method of claim 1, wherein the vehicle door assembly rotates along a swing radius between closed and open positions to cover and uncover an opening to a passenger compartment of the motor vehicle, and wherein the supervision field includes: the protected zone enveloping the swing radius, a rear projected area adjacent a rear quarter panel of the motor vehicle, and a forward projected area adjacent a front fender panel of the motor vehicle.

12. The method of claim 1, wherein the operating status of the vehicle door lock control protocol is active if a vehicle speed of the motor vehicle is below a calibrated maximum vehicle speed.

13. The method of claim 1, wherein the operating status of the vehicle door lock control protocol is active if a powertrain of the motor vehicle is in a park mode.

14. The method of claim 1, wherein the operating status of the vehicle door lock control protocol is active if a received user input selects an active status.

* * * * *